106/99
6/28/83
AU 113 EX
YR 4,390,169

United States Patent [19]

LaBate

[11] 4,390,169

[45] Jun. 28, 1983

[54] MODULAR UNIT BLAST FURNACE RUNNER AND HOT METAL GATE

[76] Inventor: Micheal D. LaBate, 115 Hazen Ave., Ellwood City, Pa. 16117

[21] Appl. No.: 234,648

[22] Filed: Feb. 17, 1981

[51] Int. Cl.[3] ..... C21B 7/14

[52] U.S. Cl. ..... 266/196; 266/287; 266/231; 266/236; 106/99

[58] Field of Search ..... 266/287, 196, 236, 231, 266/280, 282, 124; 222/600; 251/368; 106/99

[56] References Cited

U.S. PATENT DOCUMENTS

| | | | |
|---|---|---|---|
| 1,169,247 | 1/1916 | Fraser | 266/196 |
| 1,313,491 | 8/1919 | Lazzell | 222/561 |
| 2,212,987 | 8/1940 | Jung | 22/79 |
| 2,943,370 | 7/1960 | Murarsheed | 22/48 |
| 3,650,785 | 3/1972 | Ball et al. | 106/90 |
| 3,754,634 | 8/1973 | Gerbig et al. | 198/41 |
| 3,834,916 | 9/1974 | Kesler | 106/99 |
| 3,986,885 | 10/1976 | Lankard | 106/99 |
| 4,010,936 | 3/1977 | Takashima | 266/45 |
| 4,079,747 | 3/1979 | Roberts | 137/375 |
| 4,257,125 | 3/1981 | Hackman | 148/3 |
| 4,262,885 | 4/1981 | LaBate | 266/196 |
| 4,273,315 | 6/1981 | Tinnes | 266/236 |

*Primary Examiner*—L. Dewayne Rutledge
*Assistant Examiner*—Christopher W. Brody
*Attorney, Agent, or Firm*—Harpman & Harpman

[57] ABSTRACT

A hot metal gate for use in prefabricated hot metal runners takes the form of a prefabricated largely refractory unit that may be partially consumable and/or disintegratable when in contact with molten metal. The density of the material helps determine the known life of the hot metal gate when the same is exposed to molten metal in the hot metal runners. The gate is movably positioned by attachment to a lifting device.

6 Claims, 3 Drawing Figures

MODULAR UNIT BLAST FURNACE RUNNER AND HOT METAL GATE

BACKGROUND OF THE INVENTION (1) Field of the Invention

This invention relates to gates used in conjunction with the hot metal runners of my earlier patent applications; Ser. No. 123,369, filed Feb. 21, 1980, now U.S. Pat. No. 4,262,885, and allowed application Ser. No. 206,287, filed Nov. 12, 1980, which are used to direct molten metal and slag from a source to a remote point.

(2) Description of the Prior Art

Hot metal gates of this type are generally used to block or divert the flow of molten metal in an apparatus other than hot metal runners. See for example U.S. Pat. No. 3,754,634 which discloses a gate to regulate the flow height of metal from a vessel.

In U.S. Pat. No. 1,313,491, a metal gate is shown for use in a furnace feed chute.

No prior art is known which discloses a multiple layer, refractory base, hot metal gate for use in combination with modular prefabricated hot metal runners.

Applicant's hot metal gate invention requires no guide means as necessary in the prior art and is comprised of a compacted material in multiple layers of varying densities over a metal core which is not found in prior art.

SUMMARY OF THE INVENTION

A hot metal gate made of largely refractory material is used in hot metal runner systems to block and divert the flow of molten metal through the runners. The gate is formed of largely refractory material such as aluminum oxide, granulated brick grog, refractory cement and stainless steel needles. The material may also contain consumable material such as sawdust or paper pulp and/or a resin binder so that the gate has a known life when subjected to molten metal. The gate is made by the ramming or impacting of the material in a mold to form a unitary body or a body built up of progressively rammed or packed layers over a metal core. An exterior graphite coating may be used to increase the life of the gate by resisting erosion by the molten metal or slag. The gate is movable in and out of the runners by a lifting device.

DESCRIPTION OF THE PREFERRED EMBODIMENT

Figure 1:
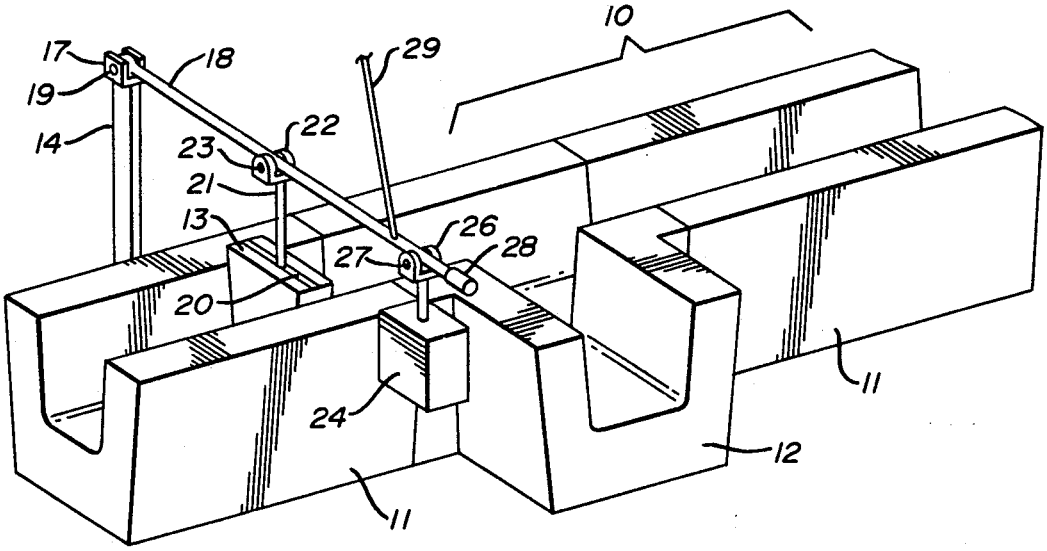
FIG. 1 is a perspective view of a hot metal gate in closed position in a hot metal runner.
Figure 2:
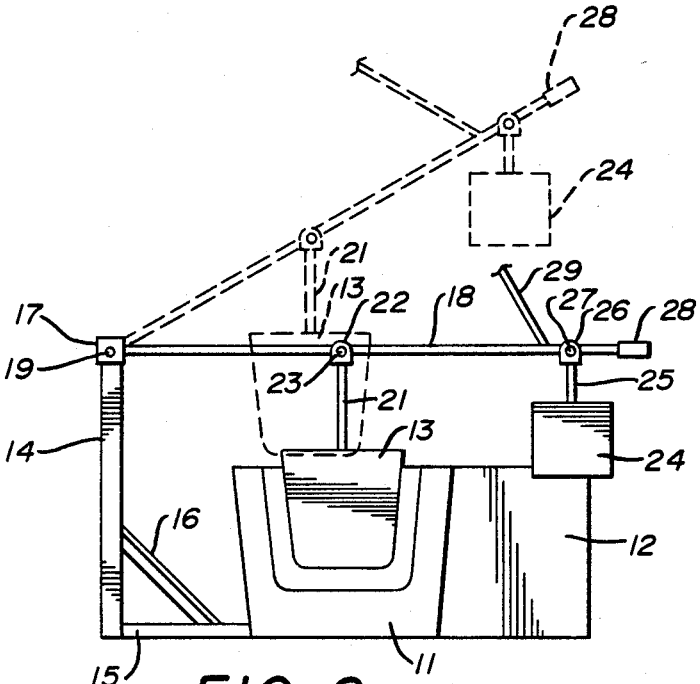
FIG. 2 is a plan view of the hot metal gate of FIG. 1, broken lines showing an alternate open position.

Referring to FIGS. 1 and 2 of the drawings, a hot metal runner system 10 like that of my earlier patent applications, Ser. Nos. 123,369 filed Feb. 21, 1980 and 206,287, filed Nov. 12, 1980 consists of modular units 11 and 12 which are interconnected and are performed of refractory material or refractory material and consumable and/or disintegratable material. Such material can comprise a mixture including clay, dolomite, paper pulp and the like and a binder which when mixed produces a consumable disintegrable product with a known rate of consumability or disintegration. The density of an article formed of the material also effects the rate of combustion and/or disintegration and its known life.

A hot metal gate 13 is disclosed and used with said runner units 11 and 12 which form a hot metal trough. The gate 13 is movably positioned by a vertical support frame 14, the lower end of which has a foot 15 secured thereto. An angular brace 16 is positioned between the vertical support frame 14 and the foot 15 and acts to stabilize the same. The upper end of said vertical support frame 14 has a bifurcated apertured bracket 17 to which one end of an elongated rod 18 is pivotally secured by a pivot pin 19.

The gate 13 is preferably formed by compacting multiple layers of refractory material over a metal core 20. The refractory material may consist of a mixture of aluminum oxide, ground brick grog, refractory cement and stainless steel needles. The material may also comprise consumable and disintegrable material similar to that of the runners 11 and 12 with the layers having different densities. A support rod 21 is secured to the core 20 and extends upwardly therefrom. The support rod 21 has a U-shaped end 22 the sides of which are apertured to receive a pivot pin 23 which also engages an aperture in the elongated rod 18 at a point inwardly of its ends. A weight 24 is pivoted to the free end of said elongated rod 18 by a connecting member 25 having an apertured U-shaped bracket 26 thereon. A pivot pin 27 attaches said bracket 26 to the rod 18. A handle 28 is provided on the end of the elongated rod 18 and it will be seen that broken lines in FIG. 2 show the gate 13 lifted out of the runner units 11 and 12.

Figure 3:
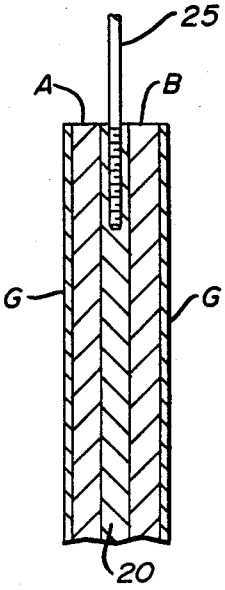
FIG. 3 is an enlarged cross sectional detail of the hot metal gate.

Referring now to FIG. 3 of the drawings, the gate 13 can be seen as having a multiple layer configuration comprising two layers of refractory material A and B formed over the metal core 20. A plurality of stainless steel rods extend from the core 20 and are embedded within the refractory layers A and B.

The refractory material can be of different densitities to increase the resistance to erosion when in contact with the molten metal.

In use the hot metal gate 13 can be used anywhere along the hot metal runner system 10 and manually lowered in place. When the flow of molten metal is in a straight path or diverted such as into the T-section 12 of the runners as seen in FIGS. 1 and 2 of the drawings, the gate 13 is moved by lifting the rod 18 by the handle 28 or by a rope 29 up and out of the metal flow as best seen in FIG. 2 of the drawings indicated in broken lines and repositioned.

When the gate 13 is in down position within the runners, the weight 24 helps hold the gate 13 in position. With use of the hot metal gate 13 easier control of the molten metal within the runners can be achieved and less foreign material introduced into the molten metal than by previous gate methods used.

It will occur to those skilled in the art that various changes and modifications may be made in the invention disclosed herein without departing from the spirit of the invention or from the scope of the appended claims.

Having thus described my invention what I claim is:

1. The combination of a modular unit blast furnace runner and a gate for movement into and out of said runner, said gate being of a shape and size conforming with said runner, said gate being formed of a refractory base material, elongated resilient stainless steel needles embedded in said refractory base material for flexibly reinforcing said gate.

2. The combination of a modular unit blast furnace runner and a gate as set forth in claim 1 wherein said gate has a metal core, a plurality of rod-like metal extensions on said metal core and multiple layers of said base refractory material thereabout.

3. The combination of a modular unit blast furnace runner and a gate therefor as set forth in claim 1 wherein said refractory base material is a mixture of aluminum oxide, ground brick grog, and refractory cement.

4. The combination of a modular unit blast furnace runner and a gate therefor as set forth in claim 1 and wherein consumable and heat disintegrable materials are added to the refractory base material so as to form a product having a predetermined lifetime when subjected to molten metal.

5. The combination of a modular unit blast furnace runner and a gate therefor as set forth in claim 1 and wherein consumable and disintegrable material comprising organic and inorganic material that change their characteristics upon subjection to molten metal temperatures are added to the refractory base material.

6. The combination of a modular unit blast furnace runner and a gate therefor as set forth in claim 1 and wherein a graphite coating is formed over said refractory base material of said gate.

* * * * *